US005240353A

United States Patent [19]

Bower et al.

[11] Patent Number: 5,240,353

[45] Date of Patent: Aug. 31, 1993

[54] ANCHOR WITH DEOPERABLE SCREW

[75] Inventors: John H. Bower, Livermore; Thomas M. Lipton, Concord, both of Calif.

[73] Assignee: Ayala Research Corporation, Livermore, Calif.

[21] Appl. No.: 981,880

[22] Filed: Nov. 25, 1992

[51] Int. Cl.[5] ..... E21D 20/00

[52] U.S. Cl. ..... 405/259.1; 405/258; 52/157

[58] Field of Search ..... 405/259.1, 259.5, 259.2, 405/262, 258, 230; 52/157, 165, 155

[56] References Cited

U.S. PATENT DOCUMENTS

| | | | |
|---|---|---|---|
| 3,786,641 | 1/1974 | Turzillo | 405/230 |
| 4,397,589 | 8/1983 | Darroussin et al. | 405/262 X |
| 4,580,795 | 4/1986 | Burtelson et al. | 405/259.1 X |
| 4,592,178 | 6/1986 | Lu | 405/259.5 X |
| 4,702,047 | 10/1987 | Stokes | 52/157 X |
| 5,066,168 | 11/1991 | Holdeman | 52/157 X |

*Primary Examiner*—Dennis L. Taylor
*Assistant Examiner*—J. Russell McBee
*Attorney, Agent, or Firm*—Flehr, Hohbach, Test, Albritton & Herbert

[57] ABSTRACT

An anchor for boring into a deformable substance which includes an elongate shaft adapted for disposition in the deformable substance is provided. The anchor has proximal and distal end portions and a central longitudinal axis. A handle is carried by the proximal end portion for causing rotation of the shaft about the axis. A drive screw is carried by the distal end portion for moving the shaft in opposite first and second longitudinal directions when the shaft is rotated in respective opposite first and second rotational directions about the axis. The anchor also includes a disengagement assembly carried by the shaft for deactivating the drive screw so that the shaft can rotate relatively freely without longitudinal movement thereof. The drive screw has an outer surface with a helical screw thread formed thereon and is rotatably mounted to the shaft distal end portion for rotation about the axis. The disengagement assembly includes a clutch assembly carried within the shaft for rotationally locking and delocking the drive screw with the shaft. In one embodiment, the end piece has a tip for piercing the soil. In another embodiment, the shaft and screw are provided with longitudinal bores therethrough for permitting the passage of soil therethrough. A fin with a leading end can be pivotly mounted near the trailing edge of the drive screw thread for increasing the torque necessary to rotate the end piece in the second rotational direction.

21 Claims, 6 Drawing Sheets

ANCHOR WITH DEOPERABLE SCREW

This invention pertains generally to anchors, and more particularly to anchors with screws at the end thereof.

Anchors have been provided for disposition in sand, soil and deformable substances for securing objects ranging in size from scuba equipment and skis to boats and construction equipment thereto. In general, these anchors can be divided into two categories: anchors of a permanent nature and anchors of a more temporary nature. Most permanent anchors cannot be readily removed or reused. On the other hand, most temporary anchors can be too easily removed and therefore do not provide meaningful protection against theft of the objects secured thereto.

It is in general an object of the invention to provide a new and improved anchor with a screw on the distal end which overcomes the limitations and disadvantages of the anchors currently provided.

Another object of the invention is to provide an anchor of the above character which can be easily placed in deformable substances such as sand or soil without the use of any tools.

Another object of the invention is to provide an anchor of the above character which can be locked to preclude its unauthorized removal from the sand or soil.

Another object of the invention is to provide an anchor of the above character to which objects can be secured.

Another object of the invention is to provide an anchor of the above character which, when unlocked, can be readily removed from the sand or soil for reuse.

Another object of the invention is to provide an anchor of the above character which can be folded for ease of storage and transportation.

These and other objects are achieved in accordance with the invention by providing an anchor for boring into deformable substances which includes an elongate shaft adapted for disposition in the deformable substance and having proximal and distal end portions and a central longitudinal axis. Means is carried by the proximal end portion for causing rotation of the shaft about the axis, and drive screw means is carried by the distal end portion for moving the shaft in a first longitudinal direction when the shaft is rotated in a first rotational direction about the axis and for moving the shaft in an opposite second longitudinal direction when the shaft is rotated in an opposite second rotational direction about the axis. The anchor also includes disengagement means carried by the shaft for deactivating the drive screw means so that the shaft can rotate relatively freely without longitudinal movement thereof.

The drive screw means includes an end piece having an outer surface with a helical screw thread formed thereon and mounting means for rotatably mounting the end piece to the distal end portion of the shaft to permit rotation about said axis. The disengagement means includes clutch means carried within the shaft for rotationally locking and delocking the end piece with the shaft. In one embodiment, the end piece has a tip for piercing the soil. In another embodiment, the shaft and end piece are formed with bore-forming inner surfaces which extend longitudinally therethrough for permitting soil to pass through the shaft and end piece as the anchor moves through the soil.

A fin with a leading end can be pivotly mounted near the trailing edge of the screw thread formed on the end piece for increasing the torque necessary to rotate the end piece in the second rotational direction. Pivot means is provided for pivoting the fin at its leading end when the shaft is rotated in the second rotational direction from a first position where the fin is in general juxtaposition with the screw thread to a second position where the fin is inclined with respect to the screw thread.

Attention is now directed to FIGS. 1 through 21, which are not necessarily drawn to scale.

Figure 1:
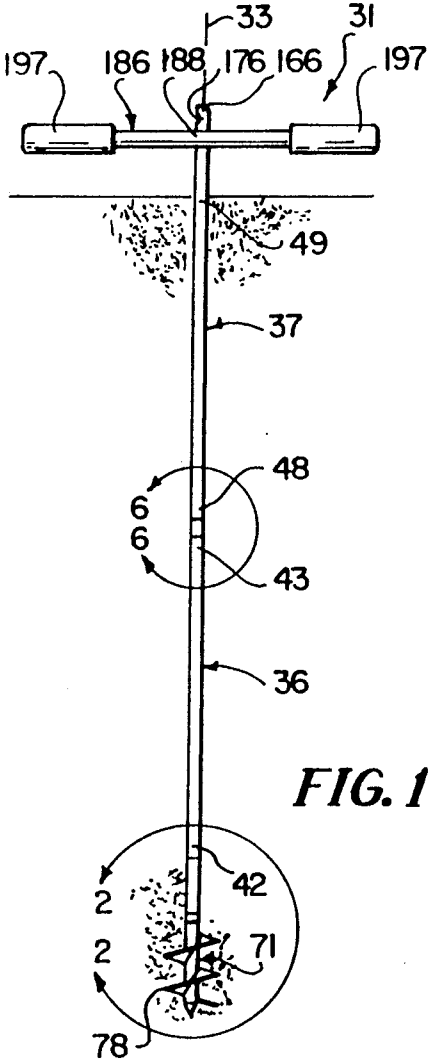
FIG. 1 is a side elevational view of the anchor with deoperable screw of the present invention embedded in soil.
Figure 6:
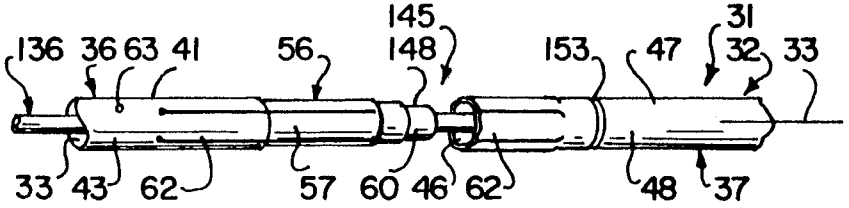
FIG. 6 is an enlarged side elevational view of a portion of the anchor shown in FIG. 1, taken along the line 6—6 of FIG. 1 and rotated 90 degrees, with the first and second shaft sections unlocked and separated.

The locking portable anchor 31 of the present invention includes an elongate tubular shaft 32 which is adapted for disposition in a deformable substance such as soil. Shaft 32 is centered on a longitudinal axis 33 and is formed from first or bottom and second or top sections 36 and 37 as illustrated in FIG. 1. Bottom section 38 has an inner bore-forming surface 38 and an outer surface 41 which are each generally circular in cross-section, and a bottom end portion 42 which serves as the distal or bottom end portion of shaft 32 and an opposite top end portion 43. Similarly, top section 37 has an inner bore-forming surface 46 and an outer surface 47 which are each generally circular in cross-section, and a bottom end portion 48 and an opposite top end portion 51 which serves as the proximal or top end portion of shaft 32. Connector 56 serves as means for rigidly joining shaft sections 36 and 37 and is generally cylindrical in shape. Connector 56 has a central portion 57 which is hexagonal in cross-section and opposite first or bottom and second or top end portions 58 and 60 of reduced diameter (See FIGS. 6 through 8). A bore-forming inner surface 61, which has a circular-shaped cross-section, extends longitudinally through end portions 58 and 60 and is generally centered on axis 33. Connector end portions 58 and 60 extend into respective top and bottom end portions 43 and 48 of shaft sections 36 and 37, with shaft end portions 43 and 48 having similar ends 62 which are hexagonal in cross-sectional shape and dimensioned for snugly and nonrotatably receiving connector central portion 57. One or more dimples 63 formed in shaft top end portion 43 serve to attach connector 56 to shaft bottom section 36.

Anchor 31 further includes drive screw means in the form of a generally tubular end piece or screw 71 carried by bottom end portion 42 (See FIGS. 1 through 5). Screw 71 is generally centered on axis 33 and has a first or bottom end portion 72 and a second or top end portion 73. Screw top end portion 73 is provided with a longitudinal bore 76 extending therethrough. Bottom end portion 72 is pressed together, shaped to form a tip and joined by any suitable means such as welding. Screw 71 has an outer surface 77 which is generally circular in cross-section and has a helical screw thread 78 formed thereon. Screw thread 78 is separately formed, having a leading edge 81 and a trailing edge 82, and is mounted to outer surface 77 by any suitable means such as welding.

Mounting means or assembly 85 is provided for rotatably mounting screw 71 to bottom end portion 42 of shaft bottom section 36 to permit rotation of the screw about axis 33 and includes a generally cylindrical first dog element 86. First dog 86 has an annular shoulder 87 thereabout from which longitudinally extends a mounting portion 88 of a reduced diameter. Extending longitudinally and in the opposite direction from mounting portion 88 along one side of first dog 86 is a locking portion 89 which is generally semicircular in cross-sectional shape and formed from a recess 90 in the first dog. Locking portion 89 has a generally planar mating surface 91 parallel with axis 33.

Mounting portion 88 is configured and sized for relatively snug disposition in screw bore 76. Mounting portion 88 is rotatably locked with and secured to screw top end portion 73 by any suitable means known to those skilled in the art such as a tubular expansion pin 92 disposed in aligned transverse bores 93 and 96 provided in screw 71 and mounting portion 88.

Figure 3:
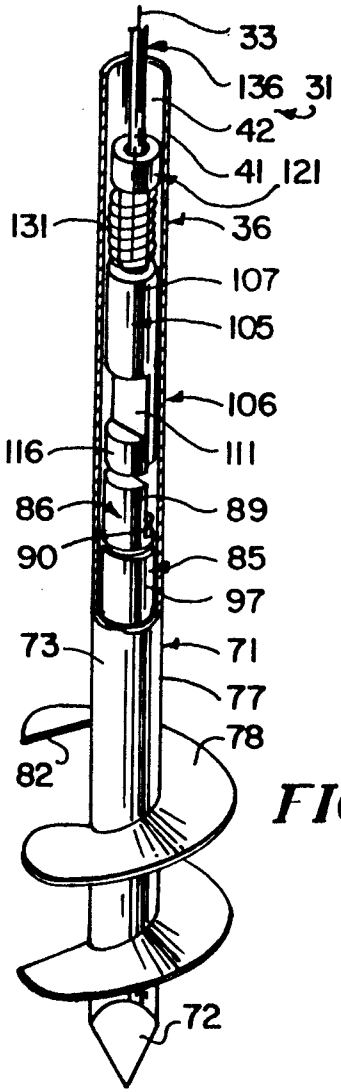
FIG. 3 is an enlarged side elevation view similar to FIG. 2 of the anchor shown in FIG. 1 with the screw in a disengaged condition.
Figure 2:
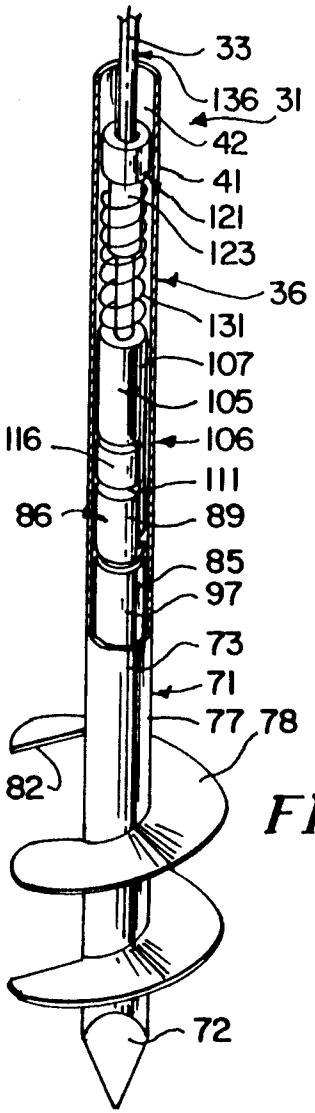
FIG. 2 is an enlarged side elevational view, partially cut away, of a portion of the anchor shown in FIG. 1 taken along the line 2—2 of FIG. 1 with the screw in an engaged condition.

First dog 86 is rotatably carried within bottom end portion 42, having a radial extremity configured and sized for slidable disposition therein. First dog 86 is rotatably retained in bottom end portion 42 by a tubular bushing 97, of a type known to those skilled in the art and made of a suitable material such as oil-less bronze, which comprises part of mounting assembly 85. Bushing 97 has an inner surface 98 radially dimensioned to slidably receive mounting portion 88 and to permit the mounting portion to angularly rotate within the bushing, and an outer surface 101 radially dimensioned for snug disposition within bottom end portion 42. The bushing is mounted to bottom end portion 42 adjacent the end thereof by annular crimps 102 which preclude longitudinal movement of the bushing with respect to shaft bottom section 36. First dog 86 and screw 71 mounted thereto are longitudinally fixed with respect to axis 33 and positioned with respect to shaft bottom section 36 by shoulder 87 generally abutting one end of bushing 97 and screw top end portion 73 generally abutting the other end of the bushing and the end of bottom end portion 42. First dog locking portion 89 extends longitudinally in shaft bottom section 36 toward top end portion 43 as shown in FIG. 3.

A second dog element 105 is slidably carried within bottom end portion 42 of shaft 32 and, together with first dog 86, serves as part of the clutch means or assembly 106 carried by shaft bottom section 36 for rotationally locking and delocking screw 71 with shaft 32. Second dog 105 moves longitudinally with respect to axis 33 between a first engaged position with first dog 86 and a second disengaged position with the first dog. The second dog is generally cylindrical in shape and has a top tubular portion 107 with a longitudinal bore 108 extending therethrough and a bottom locking portion 111 extending longitudinally from the tubular portion along one side of second dog 105. Locking portion 111 is generally semicircular in cross-sectional shape, being formed from a recess 112, and has a generally planar mating surface 113 parallel with axis 33.

Figure 4:
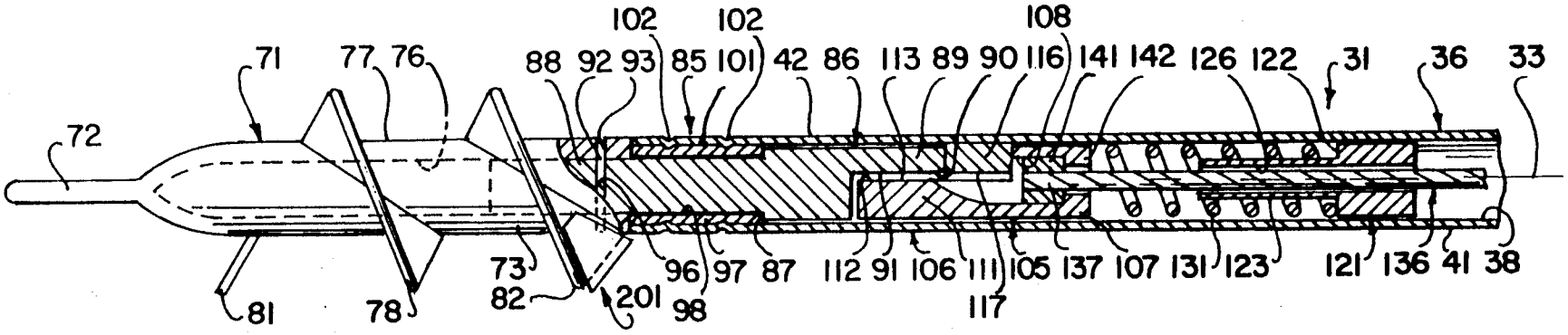
FIG. 4 is a cross-sectional view of a portion of the anchor shown in FIG. 1, rotated 90 degrees, with the screw in an engaged condition.

Second dog 105 is carried within shaft bottom section 36 so that locking portion 111 extends toward first dog 86 and bottom end portion 42. A stop 116 is included in shaft bottom section 36 for, among other things, limiting the downward longitudinal travel of second dog 105 within the bottom section. Stop 116, which has a cross-sectional shape generally complementary to second dog locking portion 111, snugly abuts and is mounted to inner surface 38 longitudinally adjacent first dog locking portion 89 by any suitable means not shown in the drawings such as welding. Second dog 105 is in a first or lower engaged position when tubular portion 107 abuts stop 116 as illustrated in FIG. 4. Dog locking portions 89 and 111 are sized so that second dog locking portion 111 can slide down shaft bottom section 36 into recess 90 and alongside first dog locking portion 89. The stop has a mating surface 117 for abutting second dog mating surface 113.

Figure 5:
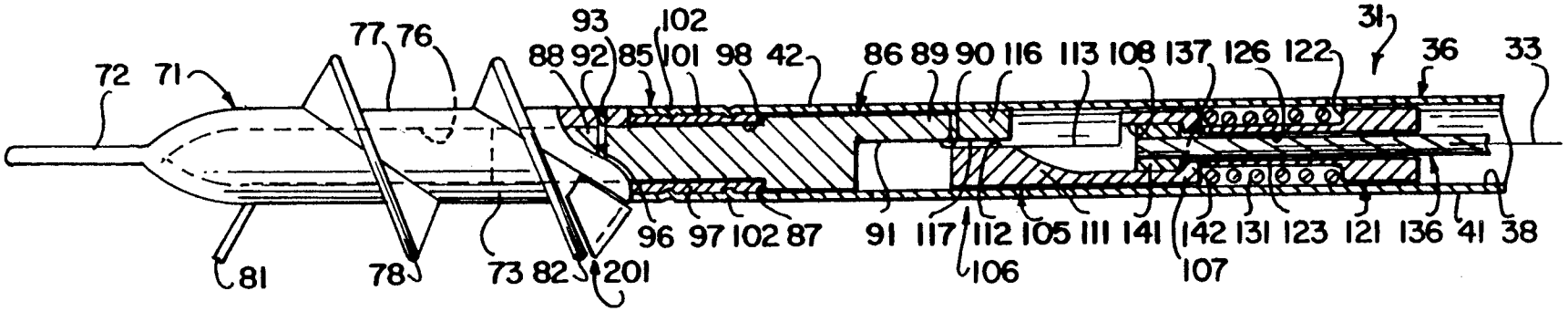
FIG. 5 is a cross-sectional view similar to FIG. 4 of the anchor shown in FIG. 1 with the screw in a disengaged condition.

A tubular bulkhead 121 is included in shaft bottom section 36 for limiting the upward longitudinal travel of second dog 105 therein. Bulkhead 121 is configured and sized to snugly abut bottom section inner surface 38 and is rigidly mounted in bottom end portion 42 at a longitudinal position inwardly stop 116 and toward top end portion 43 by any suitable means not shown in the drawings such as welding. Bulkhead 121 has an annular shoulder 122 thereabout from which a stem portion 123 of reduced diameter extends toward stop 116, and is provided with a bore 126 extending longitudinally therethrough which is generally centered on axis 33. Second dog 105 is in a second or upper disengaged position when tubular portion 107 abuts bulkhead stem portion 123 as illustrated in FIG. 5.

Stop 116 also serves as means for rotatably locking and coupling second dog 105 to shaft bottom section 36. Second dog locking portion 111 is longitudinally sized and bulkhead 121 longitudinally disposed within bottom end portion 42 so that second dog mating surface 113 generally abuts stop mating surface 117 at all times. In this manner, as illustrated in FIGS. 4 and 5, second dog 105 rotates about axis 33 with shaft bottom section 36. When dogs 86 and 105 are in the first engaged position, as illustrated in FIG. 4, first dog 86 and screw 71 mounted thereto are rotatably coupled to second dog 105. In this position, first and second dog mating surfaces 91 and 113 abut to transmit torque from second dog 105 to first dog 86. When dogs 86 and 105 are in the second disengaged position, as illustrated in FIG. 5, the dogs are rotatably decoupled.

A spring means in the form of coil spring 131 is carried within shaft bottom section 36 for biasing second dog 105 toward the first engaged or home position. Spring 131 is sandwiched between fixed bulkhead shoulder 122 and second dog tubular portion 107, exerting a constant force on the tubular portion which urges second dog 105 downwardly within bottom section 36. When spring 131 is in its compressed condition, as illustrated in FIG. 5, bulkhead stem portion 123 assists in preventing the spring from assuming a damaging distorted configuration.

Anchor 31 further includes an elongate element in the form of a flexible cable 136 made from a suitable material such as steel and ranging in gauge from one-quarter to three-eighths inch. Cable 136 extends longitudinally within the confines of shaft bottom and top sections 36 and 37, being generally centered on longitudinal axis 33, and has a first or bottom end 137 and a second or top end 138. The bottom portion of cable 136 extends through bulkhead bore 126 and second dog bore 108, with bottom end 137 being coupled to second dog 105 by means of a metal retention tube 141 attached thereabout by any suitable means such as silver soldering. Tubular portion 107 includes a radially inwardly extending lip 142 adjacent the end thereof which abuts retention tube 141. In this manner, retention tube 141 and lip 142 serve to longitudinally couple cable 136 to second dog 105. Cable 136 serves as movement means for causing relative longitudinal movement of dog elements 86 and 105 between the first engaged position where the dog elements are rotatably locked about axis 33 and the second disengaged position where the dog elements rotate about axis 33 generally freely of each other.

For assembling shaft bottom section 36, cable bottom end 137 is first fed through bulkhead 121, coil spring 131 and second dog 105 and secured within second dog bore 108 by retention tube 141 in the manner discussed above. This assembly is loaded through bottom end portion 42, and bulkhead 121 longitudinally positioned within and attached to bottom section 36. Stop 116 is then inserted in bottom end portion 42 and mounted to bottom section 36. After bushing 97 is slidably disposed about first dog mounting portion 88 and the mounting portion attached within screw bore 76 by expansion pin 92, first dog 86 and bushing 97 are slid into bottom end portion 42. Annular crimps 102 are formed on bottom section 36 for securing bushing 97, and hence first dog 86 and screw 71, to shaft 32.

Flexible cable 136 extends through the bore in connector 56 formed by inner surface 61 and is also part of a locking assembly 145 which acts as means for locking shaft bottom and top sections 36 and 37. In this regard, a hardened metal tubular sleeve 146 with an inner radial dimension sized to snugly receive cable 136 is mounted thereabout by a suitable means not shown in the drawings such as silver soldering. Sleeve 146 is formed by an outer surface 147 which is generally circular-shaped in cross-section and has a radial dimension which permits the sleeve to slidably engage connector inner surface 61.

Figure 7:
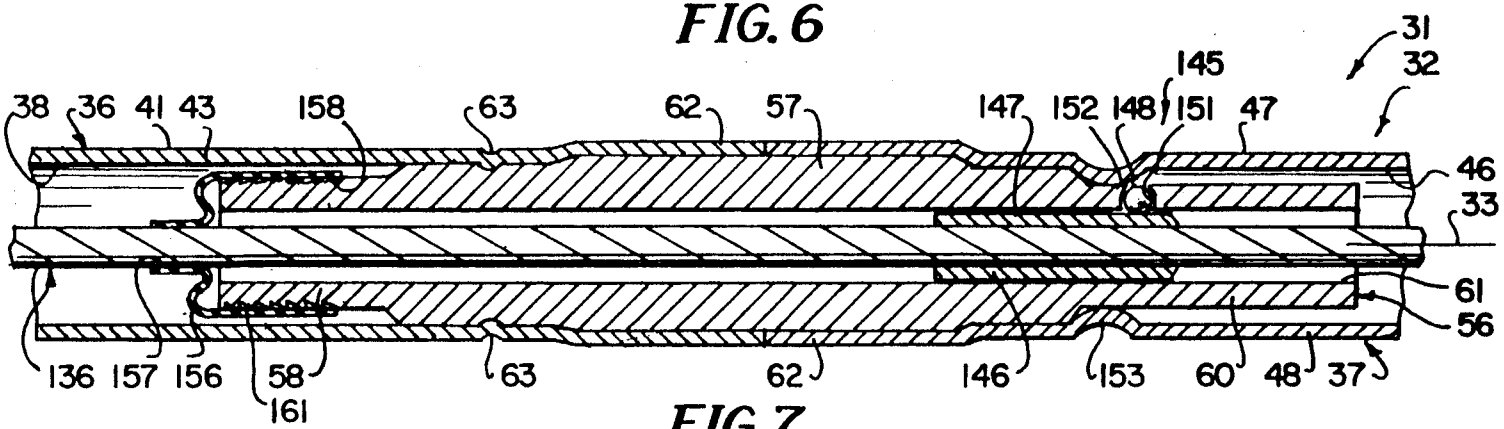
FIG. 7 is a cross-sectional view of a portion of the anchor shown in FIG. 1 rotated 90 degrees.
Figure 8:
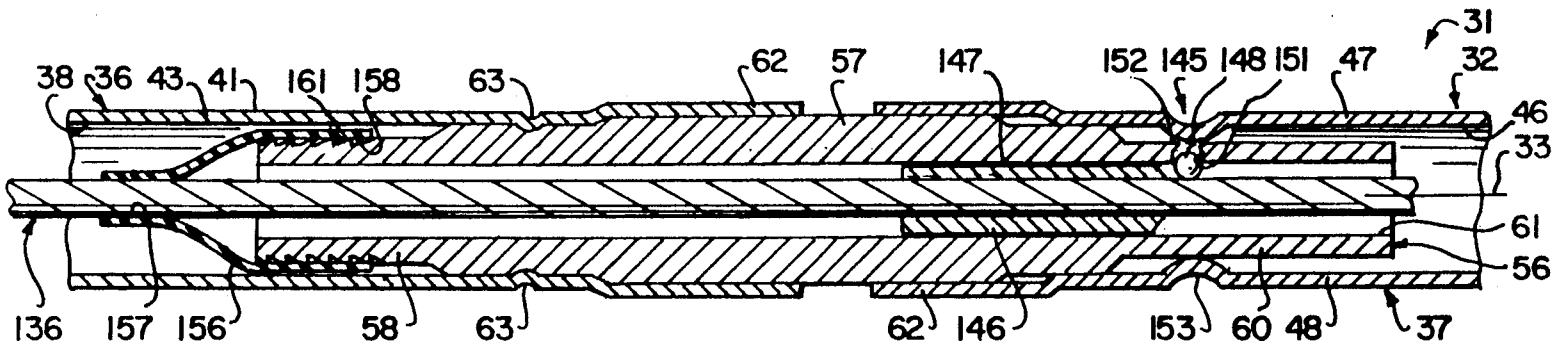
FIG. 8 is a cross-sectional view similar to FIG. 7 of the anchor shown in FIG. 1 with the first and second shaft sections unlocked and partially separated.

Locking assembly 146 further includes a ball 148 disposed in a bore 151 extending through one side of connector top end portion 73. Either cable 36 or sleeve 146 contact ball at all times within connector 56 to prevent the ball from dislodging within connector 56. A lip 152 formed on top end portion 73 defines the outer radial extremity of bore 151 and is sized to retain ball 148 within bore 151. When locking assembly 145 is in its locked position and dogs 86 and 105 are in the second disengaged position, as illustrated in FIG. 7, sleeve 146 on cable 136 abuts ball 148 and presses it against lip 152. An annular crimp 153 formed in shaft bottom end portion 48 is longitudinally positioned thereon so that when bottom and top sections 36 and 37 are tightly secured together and sleeve outer surface 147 is engaging ball 151, the ball abuts crimp 153 preventing connector 56 from sliding out of bottom end portion 48. In this manner, connector 56 and shaft bottom section 36 are longitudinally locked with shaft top section 37. Sleeve 146 has a length sufficient to continually engage ball 148 when cable 136 is pulled upwardly to move second dog 105 to its second disengaged position. When cable 136 and sleeve 146 are moved downwardly within connector 56, as illustrated in FIG. 8, the sleeve moves out from under ball 148 so that the ball can move radially inwardly a sufficient distance to permit passage of crimp 153 and separation of bottom and top sections 36 and 37.

An elastic generally tubular boot 156 is attached to connector bottom end portion 58 for preventing soil or decontaminants which may enter connector top end portion 60 and shaft top end portion 43 from traveling down shaft bottom section 36 and possibly disrupting clutch assembly 106 and/or mounting assembly 85. Boot 156 has a bottom opening 157 for snugly receiving cable 136 and an enlarged opposite top opening 158 for mounting the boot about bottom end portion 58. A plurality of annular claws 161 are provided on bottom end portion 58 for retaining boot 156 thereon.

Cable 136 is coupled to shaft top section 37. More specifically, cable top end portion 138 is mounted to a slide element or plunger 166 slidably disposed within top end portion 51 of shaft top section 37 (See FIGS. 9 through 12). Plunger 166 is generally cylindrical in shape, having an outer radial extremity sized to slidably engage top section inner surface 46. The plunger has a tapered first or bottom end portion 167, with a generally axially centered bore 168 extending therein, and an opposite second or top end portion 171 formed with first and second opposite generally planar and parallel surfaces 172. Cable top end 138 is disposed in bore 168 and secured therein by and annular crimp 173 formed therein.

Figures 9, 10, 11, 12:
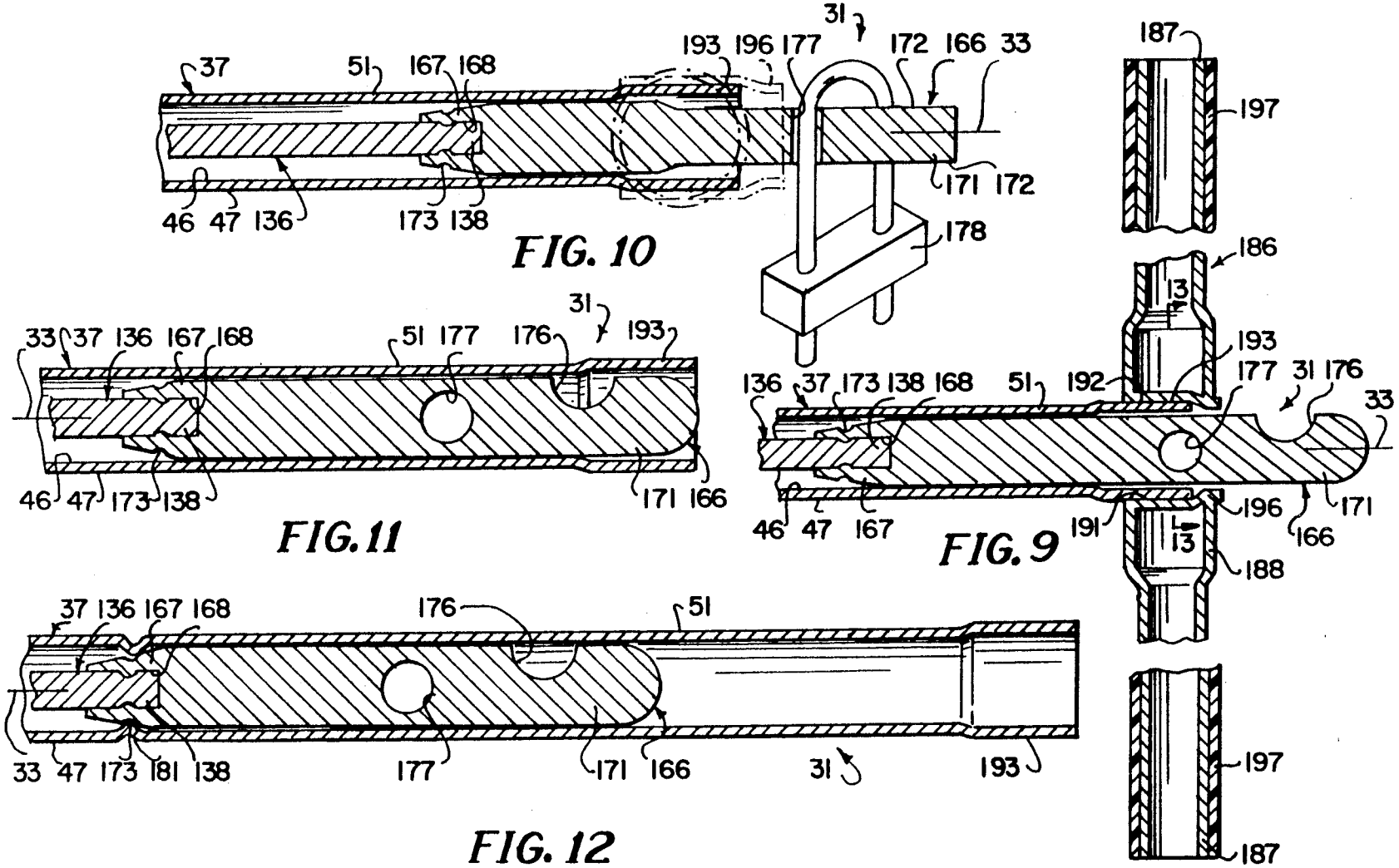
FIG. 9 is a cross-sectional view of a portion of the anchor shown in FIG. 1 when the screw is in an engaged condition.
FIG. 10 is a fragmentary cross-sectional view, similar to FIG. 9 but axially rotated 90 degrees, of the anchor shown in FIG. 1 when the screw is in a secured disengaged condition.
FIG. 11 is a fragmentary cross-sectional view similar to FIG. 9 when the first and second shaft sections are unlocked.
FIG. 12 is a fragmentary cross-sectional view similar to FIG. 9 when the first and second shaft sections are unlocked and separated.

Cable top end 138 is accessible, via plunger 166, at shaft top end portion 51 for controlling movement at top end portion 51 of second dog 105 between the first engaged and second disengaged positions discussed above. Plunger 166 is in a first home position, as shown in FIG. 9, when second dog element 105 is in its first engaged position shown in FIG. 4. Plunger 166 is pulled in a first or upwardly axial direction to a second secured position shown in FIG. 10 for disengaging second dog 105 and rotatably deactivating screw 71. When plunger 166 is released, coil spring 131 returns the plunger to its home position and second dog 105 to its engaged position. In this manner, cable 136 and plunger 166 serve as means operable from top end portion 51 of shaft top section 37 for operating clutch assembly 106.

Plunger top end portion 171 is provided with a semicircular notch 176 along one side thereof and extending between surfaces 172 for facilitating gripping and pulling thereof. Plunger top end portion 171 is also provided with retention means for retaining second dog 105 in its second disengaged position which includes bore 177 extending between surfaces 172. Bore 177 is accessible when plunger 166 is pulled to its second secured position. A padlock 178 can be inserted in bore 177, as shown in FIG. 10, for precluding plunger 166 from returning to its home position and thereby retaining anchor 31 in its rotatably decoupled and secured position. Padlock 178 also acts as securement means adapted to secure objects to anchor 31.

Plunger 166 is pushed in an opposite second or downwardly axial direction to a third position shown in FIG. 11 for unlocking locking assembly 145 to permit decoupling and separation of shaft bottom and top sections 36 and 37 as discussed above. Cable 136 is sufficiently flexible and shaft bottom section 36 has a sufficient inner radial dimension and length so that the cable can distort in section 36 as it is pushed downwardly therein to so unlock shaft sections 36 and 37. In addition, cable 136 has sufficient stiffness and the resistance forces between connector inner surface 61 and sleeve outer surface 147 are sufficiently low so that sleeve 146 and cable 136 move downwardly in connector 56 for delocking as discussed above.

Figure 15:
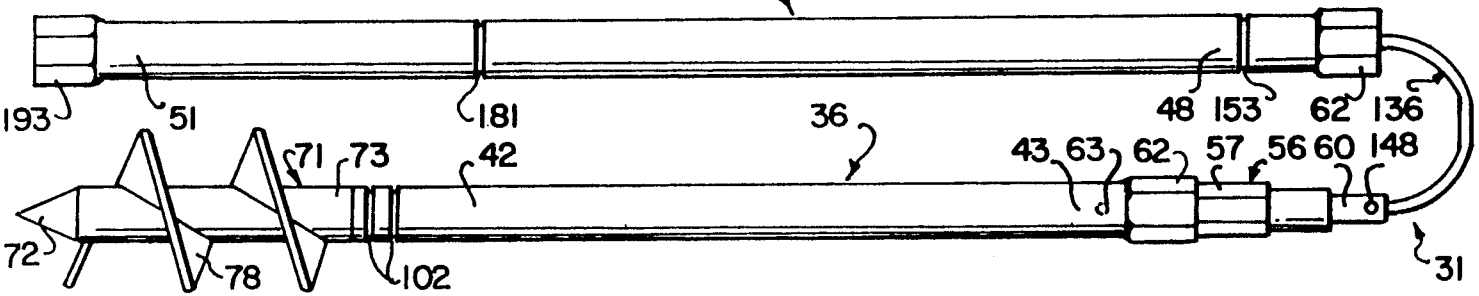
FIG. 15 is a side elevational view of the first and second shaft sections of the anchor shown in FIG. 1 in an unlocked and separated condition.

When shaft bottom and top sections 36 and 37 are unlocked and separated, cable 136 remains coupled to sections 36 and 37. Plunger 166 is precluded from sliding downwardly through shaft top section and out bottom end portion 48 by an annular crimp 181 formed in top end portion 51. Crimp 181 abuts plunger bottom end portion 167 when plunger 166 is in its downward or fourth position as illustrated in FIG. 12. Crimp 181 is longitudinally positioned on shaft top section 37 to expose sufficient cable 136 between shaft sections 36 and 37 for bending of the shaft sections as shown in FIG. 15. In this manner, cable 136 serves as means for interconnecting shaft sections 36 and 37 when the shaft is rigidly decoupled.

Figure 13:
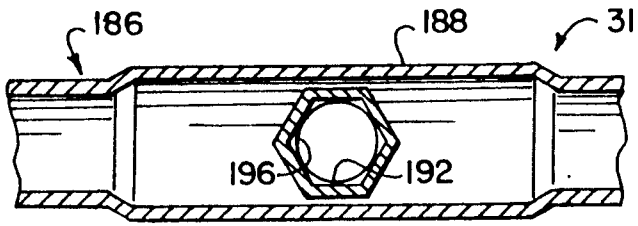
FIG. 13 is a fragmentary cross-sectional view of the anchor shown in FIG. 9 taken along the line 13—13 of FIG. 9.

Means for causing rotation of shaft 32 about longitudinal axis 33, in the form of elongate tubular handle 186, is mounted transverse of shaft top end portion 51. Handle 186, as shown in FIG. 9, has first and second end portions 187 and a central portion 188 therebetween. A bore 191 perpendicularly extends through central portion 188, being formed by an inner surface 192 which is generally hexagonal in cross-sectional shape. Shaft top end portion 51 has an end 193 which is formed to be hexagonal in cross-sectional shape and sized for snug disposition in handle bore 191. An annular lip 196 extends radially inwardly from one end of inner surface 192, as illustrated in FIG. 13, serving to restrict shaft top section 37 from extending through handle 186. Rubber tubular grips 197 are mounted on handle end portions 187 for facilitating the use of handle 186.

A drag device or fin 201 is mounted on screw thread 78 adjacent trailing edge 82 as illustrated in FIGS. 4 and 5. Fin 201 is formed from a plate 202 contoured to the shape of thread 78. Plate 202 has opposite top and bottom surfaces 203 and 206 and opposite first or leading and second or trailing ends 207 and 208. A hook 211 extends downwardly from bottom surface 206 adjacent leading end 207 and a keel element 212 extends downwardly from the center of bottom surface 206 behind hook 211. Thread 78 is provided with a first or forward and second or rear holes 213 and 216 extending therethrough and aligned, configured and sized to receive hook 211 and keel element 212.

Figure 14:
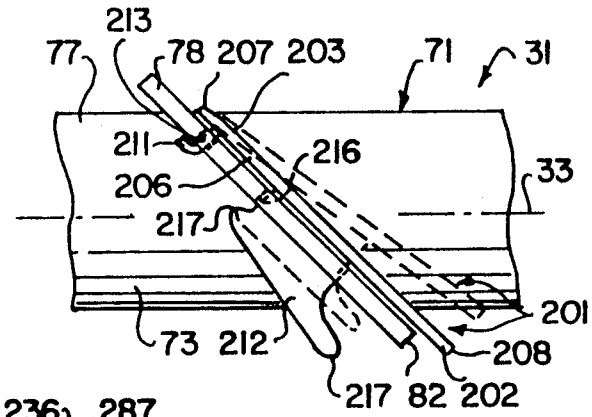
FIG. 14 is an enlarged side elevational view of a portion of the anchor screw shown in FIG. 1, rotated 90 degrees.

Fin 201 is positioned on screw thread 78 so that fin trailing end 208 extends over thread trailing edge 82. Hook 211 serves as pivot means for permitting fin 201 to pivot at leading end 207 from a first position where the fin is resting on thread 78 in general juxtaposition therewith and to a second position where the fin is inclined with respect to thread 78. The first position is shown in solid lines in FIG. 14, while the second position is shown in dotted lines in FIG. 14. Keel element 212, with opposite forwardly and rearwardly extending protrusions 217 on the bottom thereof which are sized to abut screw thread 78 adjacent rear hole 216, serves as means for limiting the pivot travel of fin 201 to its second position and for retaining keel element 212 within rear hole 216.

Shaft sections 36 and 37, connector 56, screw 71, dogs 86 and 105, stop 116, bulkhead 121, plunger 166, handle 186 and fin 201 are each made of a suitable material such as stainless steel. Anchor 31 can range from 40 to 60 inches in length, shaft bottom and top sections 36 and 37 each ranging from 15 to 25 inches in length and screw 71 ranging from five to ten inches in length. Sections 36 and 37 and screw 71 each range from five-eighths to two inches in outer diameter width. Handle is sized from 15 to 30 inches in length. Screw threads 78 can have an outer diameter ranging in size from two to five inches.

In operation and use, portable anchor 31 provides a secure anchor to soil. Separable but tethered shaft sections 36 and 37 and removable handle 186 permit anchor 31 to be easily transported and stored. Once at the desired location, shaft sections 36 and 37 are easily assembled without the use of tools, connector 56 and locking assembly 145 longitudinally and angularly locking the shaft sections together. Handle 186 is mounted to shaft top end portion 51.

When placing anchor 31 in soil, screw bottom end portion or tip 72 serves to pierce the soil. With plunger 166 in its home position and dogs 86 and 105 in their first rotatably locked engaged position, handle 186 is rotated in a first or clockwise direction about axis 33. As the handle is so rotated, shaft 32 rotatably locked thereto moves in a first longitudinal or downwardly direction through the soil. Shaft sections 36 and 37 have generally smooth outer surfaces 41 and 47 which are free of projections for reducing the resistance or drag forces on anchor 31 as it travels through the soil. If desired, a wrench or other standard tool can be used together with or in lieu of handle 186 for rotating shaft 32. Shaft ends 62 and top end portion 51 have hexagonal configurations which facilitate gripping by such tools.

Once anchor 31 reaches the desired depth in the soil, plunger 166 is pulled to its second position for placing dogs 86 and 105 in their second disengaged position. With clutch assembly 106 now disengaged, screw 71 is no longer rotatably locked with shaft 32. Further rotation of handle 186 or shaft 32 in either a clockwise or counterclockwise direction will not advance or withdraw anchor 31 from the soil. In this manner, dogs 86 and 105 and bushing 97 act as disengagement means for deactivating screw 71 so that shaft 32 can rotate relatively freely without longitudinal movement thereof in the soil.

The forces necessary to remove anchor 31 from the soil depend on the size and configuration of screw 71 and screw threads 78, the depth of installation and the characteristics of the substance into which anchor 31 is disposed. Tests have shown that forces in excess of 1,000 pounds are required to pull out a disengaged or secured anchor 31 screwed to a depth of 30 inches in packed soil when screw threads 78 are approximately two inches in outer radial diameter. In other experiments, a force in excess of 2,000 pounds has been required to pull out an anchor 31 having screw threads 78 of approximately three and one-half inches in outer radial diameter which has been installed to a depth of 42 inches in beach sand.

It has been found that the torque necessary to withdraw an installed screw 78 is significantly less than the torque necessary to install it. Fin 201 serves to increase the torque necessary to withdraw screw 71 from the soil. Mounted on screw thread 78 adjacent its trailing edge 82, fin trailing end 208 extends over trailing edge 82 so as to engage the soil as screw 71 is rotated in a second rotational or counterclockwise direction. The soil acts on fin bottom surface 206 causing it to pivot about leading end 207 to its second position. Rear keel protrusion 217 abuts screw thread 78 adjacent rear hole 216 to counteract the uplifting forces exerted by the soil on fin 201 and prevents separation of the fin from the screw thread. In its second position, fin 201 increases the soil necessary to be displaced by screw thread 78 as it backs out of the soil.

Fin 201 ensures, when anchor 31 is locked and secured and clutch assembly 106 disengaged, that the screw withdrawing torque exceeds the breakaway force between screw 71 and shaft bottom section 36. This can be particularly important if soil or other decontaminants have lodged between bushing 97 and first dog 86 so as to increase the resistance or breakaway forces necessary to rotate screw 71 with respect to shaft bottom section 36. In this manner, fin 201 acts as means for hindering rotation of screw 78 in a counterclockwise direction about axis 33 and for hindering longitudinal movement of screw 71 and shaft 32 in the second or upward direction in the soil.

Plunger 166 can be retained in its second secured position by placing a padlock 178 through bore 177 therein. Padlock 178 abuts against handle 186 or shaft top end portion 51 to resist the biasing forces of coil spring 131. With padlock 178 so installed, clutch assembly 106 cannot be engaged and shaft sections 36 and 37 cannot be unlocked. The padlock can also be used for securing objects to anchor 31.

Anchor 31 is easily removed from the soil. Once padlock 178 is removed from plunger 166, coil spring 131 returns dogs 86 and 105 to their first engaged position. Some rotation of shaft 32 may be necessary to rotatably align the dogs about axis 33. Once clutch assembly 106 is so engaged, rotation of shaft 32 by handle 186 in a second rotational or counterclockwise direction about axis 33 moves withdraws anchor 31 from the soil by moving shaft 32 in an upwardly direction. As discussed above, counterclockwise rotation of screw 71 causes fin 201 to pivot to its second position, thereby increasing the torque otherwise necessary to remove shaft 32 from the soil.

Once removed from the soil, anchor 31 is disassembled for transportation and storage by removing handle 186 therefrom and unlocking shaft bottom and top sections 36 and 37 by pushing plunger down within shaft top end portion 43 to unlock locking assembly 145 in the manner discussed above. Shaft sections 36 and 37 remain interconnected by cable 136 for storage and future ease of assembly.

The portable locking anchor of the present invention can have other configurations for suiting the desired use or otherwise and be within the scope of the present invention. For example, an anchor used for securing large objects such as construction equipment, watercraft or portable building may have a larger radial diameter than an anchor used for securing smaller objects such as scuba gear, bicycles or camping equipment. For anchors desired to be of a more permanent nature, such as for flag poles, antennas or survey bench marks which are not expected to be removed once installed, the disengagement means for deactivating the screw means can be a shear pin or similar nonreactivating device. The portable locking anchor of the present invention can also be used in other generally loose materials or earth surfaces or substances such as sand, gravel or snow. In addition, the anchors of the present invention can be used in deformable substances such as wood.

Figure 20:
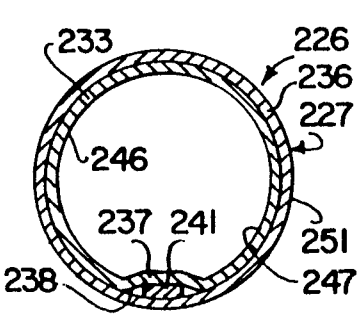
FIG. 20 is a cross-sectional view of the anchor shown in FIG. 17 taken along the line 20—20 of FIG. 17.

By way of example, another embodiment of the present invention is illustrated in FIGS. 16 through 21. Locking portable anchor 226 includes an elongate shaft 227 adapted for disposition in a deformable substance such as soil. Shaft 227, which is generally circular in cross-sectional shape and centered on a longitudinal axis 228, has distal or bottom and proximal or top end portions 231 and 232. The shaft is formed from inner and outer tubes 233 and 236 which are each made of a suitable material such as stainless steel and are colinear with axis 228. For simplicity, tubes 233 and 236 are not shown in FIG. 16. Inner tube 233 is concentrically carried within and mounted to outer tube 236 (See FIGS. 17 and 18). Tubes 233 and 236 are welded or otherwise suitably joined together, inner tube 233 being formed with a crease 237 along one side thereof to provide a longitudinal separation 238 which extends longitudinally between the tubes. An elongate second dog element or rod 241 having opposite bottom and top end portions 242 and 243 is slidably disposed in separation 238. Rod 241 is made of a suitable material such as stainless steel. Crease 237 is sized and configured, as illustrated in FIG. 20, so that rod 241 is generally angularly fixed between tubes 233 and 236 and rotatably locked with shaft 227.

Inner tube 233 has an inner surface 246 extending longitudinally therethrough, which forms a central bore 247 and serves as shaft 227 inner surface, and a bottom end 248. Outer tube 237 has an outer surface 251 which serves as the outer surface of shaft 227, and a bottom sleeve portion 252 which extends beyond end 248 and has a distal or bottom end 253.

Anchor 226 further includes drive screw means in the form of a generally tubular end piece or screw 261 made of a suitable material such as stainless steel and generally centered on axis 228. Screw 261 has first or bottom and second or top end portions 262 and 263 and a generally circular cross-sectional shape. A bore 266 formed by an inner surface 267 extends longitudinally through end portions 262 and 263. Screw end portion 263 serves as a mounting portion and has an outer surface 268 with a plurality of longitudinally aligned first dog elements or blocks 269 welded or otherwise suitably mounted thereon. Blocks 269 are spaced circumferentially about the outside of screw end portion 263 adjacent the end thereof (See FIGS. 18, 19 and 21). Bottom end portion 262 generally tapers toward the end thereof for serving as a hollow screw tip and has an outer surface 271 with a helical screw thread 272, substantially similar to screw thread 78, formed thereon. Outer surfaces 268 and 271 are separated by an annular shoulder 273.

A mounting means or assembly 276 substantially similar to mounting assembly 85 is provided for rotatably mounting screw 261 to shaft bottom end portion 231 to permit rotation of the screw about axis 228. Mounting assembly 276 includes a tubular bushing 277 made of a suitable material such as oil-less bronze. Bushing 277 has an inner surface 278 radially dimensioned to slidably receive screw mounting portion 263 and permit mounting portion 263 to angularly rotate within the bushing, and an outer surface 281 radially dimensioned for snug disposition within outer tube sleeve portion 252. The bushing is mounted to sleeve 252 adjacent the end thereof by annular crimps 282 which preclude longitudinal movement of the bushing with respect to shaft bottom end portion 231. Annular shoulder 273 generally abuts outer tube end 253 and bushing 277 and screw top end portion 263 generally abuts inner tube bottom end 248 for limiting the upward longitudinal movement of screw 261 with respect to shaft 227. A spacer 283 is mounted to sleeve portion 252, by any suitable means not shown in the drawings such as welding, between the sleeve portion and screw top end portion 263. Spacer 283 is disposed adjacent and between bushing 277 and blocks 269 and generally abuts the blocks for limiting the downward longitudinal movement of screw 261 with respect to shaft 227.

Blocks 269 and rod 241 serve as part of clutch means or assembly 287 for rotatably locking screw 261 with shaft 227. More specifically, blocks 269 are sized and spaced apart so that rod bottom end portion 243 can slide in between adjacent blocks 269, as illustrated in FIG. 19, for engaging clutch assembly 287.

Figure 21:
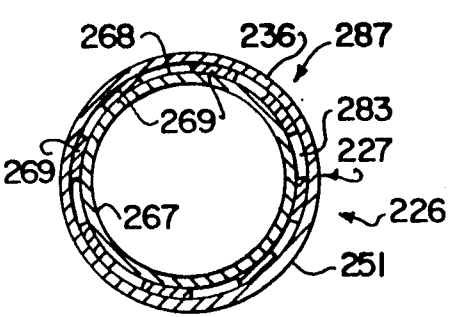
FIG. 21 is a cross-sectional view of the anchor shown in FIG. 18 taken along the line 21—21 of FIG. 18.
Figure 19:
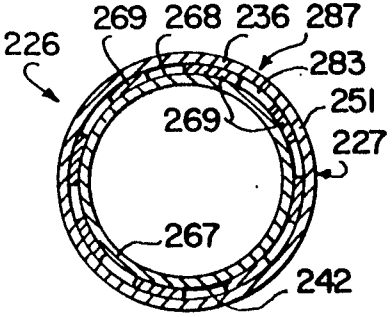
FIG. 19 is a cross-sectional view of the anchor shown in FIG. 17 taken along the line 19—19 of FIG. 17.
Figure 18:
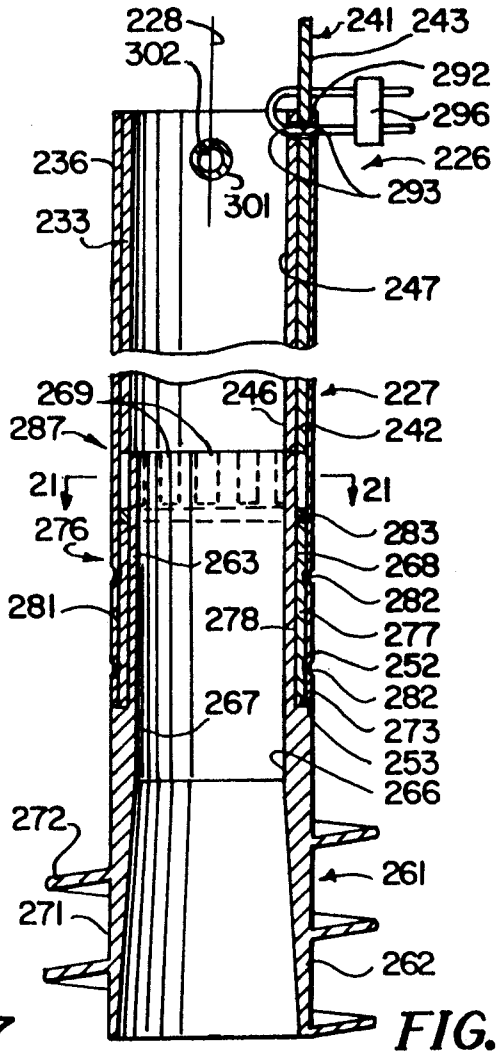
FIG. 18 is a fragmentary cross-sectional view similar to FIG. 17 of the anchor shown in FIG. 16 with the screw in a disengaged condition.
Figure 17:
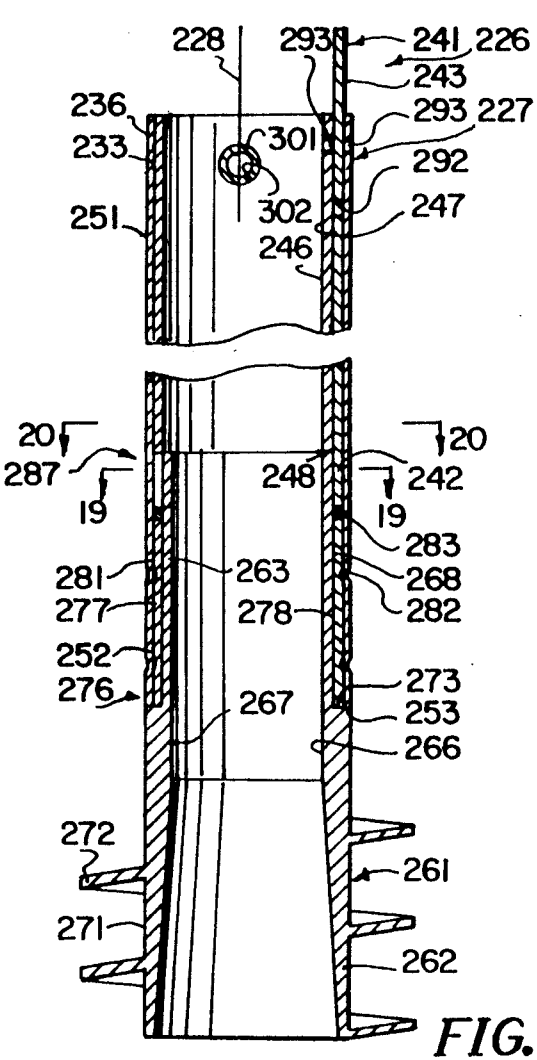
FIG. 17 is a cross-sectional view of the anchor shown in FIG. 16 taken along the line 17—17 of FIG. 16 with the screw in an engaged condition.
Figure 16:
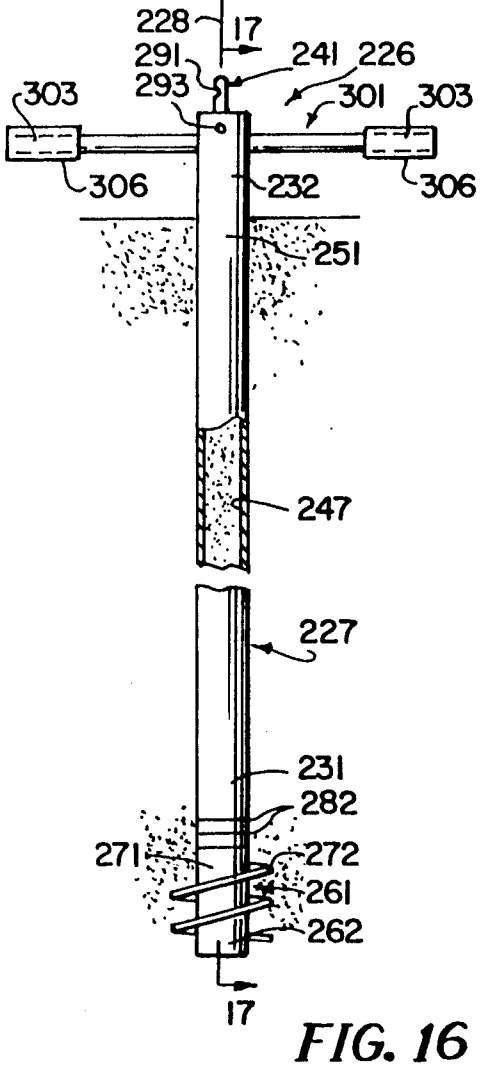
FIG. 16 is a side elevational view, partially cut away, of another embodiment of the anchor with deoperable screw of the present invention embedded in soil.

Rod 241 is longitudinally sized so that top end portion 243 extends above shaft top end portion 232 and is accessible for the operator to grasp rod end portion 243 and move rod 241 between a first engaged position where rod 241 and blocks 269 are rotatably locked about axis 228, as illustrated in FIGS. 17 and 19, and a second disengaged position where rod 241 and blocks 269 rotate about axis 228 generally freely of each other, as illustrated in FIGS. 18 and 21. Spacer 283 limits the downward travel of rod 241 and protects bushing 277 from damage therefrom.

Rod top end portion 243 is provided with a semicircular notch 291 along one side thereof for facilitating gripping and pulling of rod 241. Notch is accessible above shaft 227 when rod 241 is in both its first engaged position and its second disengaged position. Rod top end portion 243 is also provided with a bore 292 therethrough which aligns with a transverse bore 293 in shaft top end portion 232, extending through one side of tubes 233 and 236 in angular alignment with separation 238 therebetween, when plunger rod 241 is pulled to its second disengaged position. Bores 292 and 293 serve as retention means for retaining rod 241 in its second disengaged position. A padlock 296 can be inserted through bores 292 and 293, as shown in FIG. 18, for retaining rod 241 in its second position and thereby retaining anchor 226 in its rotatably decoupled and locked position. Padlock 296 also acts as securement means adapted to secure objects to anchor 226.

Means for causing rotation of shaft 227 about longitudinal axis 228, in the form of elongate tubular handle 301 made of a suitable material such as stainless steel, is mounted transverse of shaft top end portion 232. Handle 301 is disposed in a transverse bore 302 extending through tubes 233 and 236 as illustrated in FIGS. 17 and 18. Bore 302 is angularly separated approximately 90 degrees about axis 228 from separation 238 and bore 293. Handle 301 has opposite first and second end portions 303 with rubber tubular grips 306 mounted thereon for facilitating the use of handle 301.

Anchor 226 operates in substantially the same manner as anchor 31. Once shaft 227 is aligned with screw 261 so that rod 241 can be pushed downwardly between adjacent blocks 269 to its first engaged position, anchor 226 moves downwardly through the soil in a first longitudinal direction when rotated in a first rotational or clockwise direction about axis 228 and upwardly in an opposite second longitudinal direction when rotated in a second rotational or counterclockwise direction about axis 228.

Shaft 227 and screw 261 are hollowed, having respective bores 247 and 266 extending therethrough, for permitting the soil to pass longitudinally through anchor 226 as the anchor passes therethrough. Bore-forming inner surfaces 246 and 267 are generally centered on and colinear about axis 228 and free of projections for facilitating the passage of soil through anchor 226.

Once the desired installation depth has been reached, screw 261 is rotatably disengaged and deactivated by pulling rod 241 to its second secured position as discussed above. With rod 241 in this position, shaft 227 can be rotated relatively freely without longitudinal movement thereof.

The relatively large radial dimension of anchor 226, as compared to anchor 31, permits significant torque to be applied to the anchor if necessary for installation. The hollow configuration of anchor 226 reduces significantly the frontal area of the anchor requiring far less soil to be pushed out of the way than would be required for an anchor similar to anchor 31 having an equivalent radial dimension. The significant radial dimension also adds to the stability of the anchor once installed and increases the forces necessary to forcibly remove the anchor when locked. In addition, the large radial dimension distributes the side load stress from anchor 227 over a wide area of soil or substance making the anchor particular secure with respect to side loads; these features are particularly helpful when anchor 227 is used for a flag pole, a tent stake or a guy wire anchor.

It is apparent from the foregoing that a new and improved anchor with a screw on the distal end has been provided. The anchor can be easily placed in deformable substances such as sand or soil without the use of any tools and locked to preclude its unauthorized removal therefrom. Objects can be secured to the anchor which, when unlocked, can be readily removed from the sand or soil for reuse. The anchor can be folded for ease of storage and transportation.

The foregoing descriptions of specific embodiments of the present invention have been presented for purposes of illustration and description. They are not intended to be exhaustive or to limit the invention to the precise forms disclosed, as many modifications and variations are possible in light of the above teaching. The embodiments were chosen and described in order to best explain the principles of the invention and its practical application, and to thereby enable others skilled in the art to best utilize the invention and various embodiments with various modifications as are suited to the particular use contemplated. It is intended that the scope of the invention be defined by the claims appended hereto and their equivalents.

What is claimed is:

1. An anchor for boring into deformable substances comprising an elongate shaft adapted for disposition in the deformable substance and having proximal and distal end portions and a central longitudinal axis, means carried by the proximal end portion for causing rotation of the shaft about the axis, drive screw means carried by the distal end portion for moving the shaft in a first longitudinal direction when the shaft is rotated in a first rotational direction about the axis and for moving the shaft in an opposite second longitudinal direction when the shaft is rotated in an opposite second rotational direction about the axis, and disengagement means carried by the shaft for deactivating the drive screw means so that the shaft can rotate relatively freely without longitudinal movement thereof.

2. An anchor as in claim 1 wherein said drive screw means includes an end piece having an outer surface with a helical screw thread formed thereon and mounting means for rotatably mounting the end piece to said shaft distal end portion to permit rotation about said axis, and wherein said disengagement means includes clutch means carried by the shaft for rotationally locking and delocking the end piece with the shaft.

3. An anchor as in claim 2 together with means operable from said proximal end portion for operating said clutch means.

4. An anchor as in claim 2 wherein said clutch means is carried within said shaft.

5. An anchor as in claim 2 wherein said clutch means is carried by said shaft distal end portion.

6. An anchor as in claim 2 wherein said clutch means includes a first dog element rotatably locked with said drive screw means and a second dog element rotatably locked with said shaft, movement means carried by said shaft for causing relative longitudinal movement of the dog elements between a first engaged position where the dog elements are rotatably locked about said axis and a second disengaged position where the dog elements rotate about the axis generally freely of each other.

7. An anchor as in claim 6 wherein said first dog element is longitudinally fixed with respect to said axis and said second dog element moves longitudinally with respect to the axis between said first engaged position and said second disengaged position.

8. An anchor as in claim 7 wherein said clutch means is carried by said shaft distal end portion and wherein said movement means further includes an elongate element having one end coupled to said second dog element and a second end accessible at said shaft proximal end portion for controlling at the proximal end portion movement of the second dog element between said first and second positions.

9. An anchor as in claim 8 wherein said elongate element is a flexible cable.

10. An anchor as in claim 7 together with a spring means carried by said shaft for biasing said second dog element toward said first engaged position.

11. An anchor as in claim 10 together with retention means accessible from said shaft proximal end portion for retaining said second dog element in said second disengaged position.

12. An anchor as in claim 11 wherein said retention means includes securement means adapted to secure objects to the anchor.

13. An anchor as in claim 2 wherein said clutch means includes a first dog element mounted to said drive screw means and a second dog element rotatably locked with said shaft, the second dog element having an end portion accessible at said shaft proximal end portion for moving the second dog element between a first engaged position where the dog elements are rotatably locked about said axis and a second disengaged position where the dog elements rotate about the axis generally freely of each other.

14. An anchor as in claim 2 wherein said end piece has a tip for piercing the soil.

15. An anchor as in claim 2 wherein said shaft and end piece are formed with bore-forming inner surfaces extending longitudinally therethrough and generally centered on and colinear about said axis for permitting soil to pass through the shaft and end piece as the anchor moves through the soil.

16. An anchor as in claim 2 together with a fin mounted on said screw thread, the fin being formed with opposite leading and trailing ends, and pivot means for permitting the fin to pivot at the leading end when the end piece is rotated in the second rotational direction from a first position where the fin is in general juxtaposition with the screw thread to a second position where the fin is inclined with respect to the screw thread.

17. An anchor as in claim 1 wherein said shaft is formed from first and second sections, means for interconnecting the first and second shaft sections which includes a cable with a first end coupled to the first section and a second end coupled to the second section.

18. An anchor as in claim 1 wherein said shaft is formed from first and second sections and wherein said anchor further comprises an elongate element extending longitudinally within the confines of the shaft, the elongate element having an end accessible at said shaft proximal end portion which is movable in a first axial direction for deactivating the drive screw means and is movable in an opposite second axial direction for decoupling the first and second shaft sections.

19. An anchor for boring into a deformable substance comprising an elongate shaft adapted for disposition in the deformable substance and having proximal and distal end portions and a central longitudinal axis, means carried by the proximal end portion for causing rotation of the shaft about the axis, and drive screw means carried by the distal end portion for moving the shaft in a first axial direction when the shaft is rotated in a first rotational direction about the axis and for moving the shaft in an opposite second axial direction when the shaft is rotated in an opposite second rotational direction about the axis, the drive screw means including a helical screw thread with a fin mounted thereon, the fin being formed with opposite leading and trailing ends, and pivot means for pivoting the fin at the leading end when the shaft is rotated in the second rotational direction from a first position where the fin is in general juxtaposition with the screw thread to a second position where the fin is inclined with respect to the screw thread.

20. An anchor for boring into a deformable substance comprising an elongate tubular shaft adapted for disposition in the deformable substance and having proximal and distal end portions and a central longitudinal axis, a handle mounted transverse of the proximal end portion of the shaft for causing rotation of the shaft about the axis, an end piece having an outer surface with a helical screw thread formed thereon, means for rotatably mounting the end piece to the shaft distal end portion to permit rotation about the axis, clutch means carried within the shaft for rotationally locking the end piece with the shaft so that the shaft moves in a first longitudinal direction when the shaft is rotated in a first rotational direction about the axis and in an opposite second longitudinal direction when the shaft is rotated in an opposite second rotational direction about the axis and for rotationally delocking the end piece with the shaft so that the shaft can rotate relatively freely without longitudinal movement thereof, the clutch means including a first dog element rotatably locked with the end piece and a second dog element rotatably locked with the shaft, and an elongate element with a first end coupled to one of the dog elements and a second end accessible at the shaft proximal end portion for causing relative longitudinal movement of the dog elements between a first engaged position where the dog elements are rotatably locked about said axis and a second disengaged position where the dog elements rotate about the axis generally freely of each other.

21. An anchor for boring into a deformable substance comprising an elongate tubular shaft adapted for disposition in the deformable substance and having proximal and distal end portions and a central longitudinal axis, a handle mounted transverse of the proximal end portion of the shaft for causing rotation of the shaft about the axis, an end piece having an outer surface with a helical screw thread formed thereon, means for rotatably mounting the end piece to the shaft distal end portion to permit rotation about the axis, and clutch means carried within the shaft for rotationally locking the end piece with the shaft so that the shaft moves in a first longitudinal direction when the shaft is rotated in a first rotational direction about the axis and in an opposite second longitudinal direction when the shaft is rotated in an opposite second rotational direction about the axis and for rotationally delocking the end piece with the shaft so that the shaft can rotate relatively freely without longitudinal movement thereof, the clutch means including a first dog element mounted to the end piece and a second dog element rotatably locked with the shaft and having an end portion accessible at the shaft proximal end portion for causing at the proximal end portion movement of the second dog element between a first engaged position where the dog elements are rotatably locked about said axis and a second disengaged position where the dog elements rotate about the axis generally freely of each other, and the shaft and end piece formed with bore-forming inner surfaces extending longitudinally therethrough and generally centered on and colinear about the axis for permitting soil to pass through the shaft and end piece as the anchor moves through the soil.

* * * * *